United States Patent [19]

Leong

[11] Patent Number: 5,024,602

[45] Date of Patent: Jun. 18, 1991

[54] ELECTRICAL GROUNDING PRONG SOCKET

[75] Inventor: Robert Leong, Dublin, Calif.

[73] Assignee: The United States of America as represented by the United States Department of Energy, Washington, D.C.

[21] Appl. No.: 531,437

[22] Filed: May 31, 1990

Related U.S. Application Data

[63] Continuation-in-part of Ser. No. 406,005, Sep. 12, 1989, abandoned.

[51] Int. Cl.[5] ..... H01R 13/11

[52] U.S. Cl. ..... 439/107; 439/851

[58] Field of Search ..... 439/851-854, 439/855, 842, 825, 106, 107, 685

[56] References Cited

U.S. PATENT DOCUMENTS

| | | | |
|---|---|---|---|
| 2,551,423 | 5/1951 | DeVito | 173/363 |
| 3,158,425 | 11/1964 | Pritulsky | 439/853 |
| 3,467,939 | 9/1969 | Martin | 399/14 |
| 3,842,391 | 10/1974 | Dechelette | 439/842 |
| 3,891,289 | 6/1975 | Hanke | 399/14 |
| 4,018,492 | 4/1977 | Eckart | 399/14 |
| 4,035,045 | 7/1977 | Trevithick | 399/14 |
| 4,071,872 | 1/1978 | Phillips | 361/56 |
| 4,386,813 | 6/1983 | Griffin | 439/107 |

FOREIGN PATENT DOCUMENTS

| | | | |
|---|---|---|---|
| 944875 | 4/1949 | France | 439/851 |
| 1554392 | 1/1969 | France | 439/851 |
| 2507831 | 12/1982 | France | 439/851 |
| 6511905 | 3/1967 | Netherlands | 439/842 |

*Primary Examiner*—Gary F. Paumen

*Attorney, Agent, or Firm*—Michael Lee; L. E. Carnahan; William R. Moser

[57] ABSTRACT

The invention is a socket for a grounding prong used in a three prong electrical plug and a receptacle for the three prong plug. The socket being sufficiently spacious to prevent the socket from significantly stretching when a larger, U-shaped grounding prong is inserted into the socket, and having a ridge to allow a snug fit when a smaller tubular shape grounding prong is inserted into the socket.

4 Claims, 5 Drawing Sheets

ELECTRICAL GROUNDING PRONG SOCKET

The United States Government has rights in this invention pursuant to Contract No. W-7405-ENG-48 between the U.S. Department of Energy and the University of California, for the operation of Lawrence Livermore National Laboratory.

This application is a continuation-in-part of application Ser. No. 406,005, filed Sept. 12, 1989, now abandoned.

BACKGROUND OF THE INVENTION

For three prong electrical plugs used in the United States of America, which are classified by the National Electrical Manufacturing Association as 5-15, two flat prongs are used to conduct an electrical current and a third prong is used as a grounding prong. In the United States of America, there are at least two different kinds of grounding prongs. One type of grounding prong has a U-shaped cross-section. FIG. 1 illustrates a cross-sectional perspective view of a U-shaped grounding prong 36. The width, height, horizontal distance, and vertical distance or the U-shaped prong 36 are defined in this application as illustrated in FIG. 1. A line 19 is a line representing the central axis of the U-shaped grounding prong. The width of the U-shaped grounding prong is the horizontal distance, which is perpendicular to the central axis of the U-shaped grounding prong, from the outside of a first foot 21 of the U-shaped grounding prong to the outside of a second foot 23 of the U-shaped grounding prong. The U-shaped cross-section has a width 22 of 0.184 inches and a height 20 of 0.200 inches. The height of the U-shaped prong is defined as the vertical distance from the bottom of the first foot 21 of the U-shaped grounding prong to the top of the arc 25 of the U-shaped grounding prong. The vertical distance is the distance perpendicular to the horizontal distance and the central axis of the grounding prong. In the U-shaped grounding prong shown in FIG. 1 the top of the arc 25 is equidistant from the bottom of the first foot 21 and the bottom of the second foot 23 of the U-shaped grounding prong 36. A second type of grounding prong is a tubular grounding prong which has a circular cross-section. A cross-sectional perspective view of the tubular grounding prong 30 is illustrated in FIG. 2. In the United States the diameter 24 of the circular cross-section of the tubular grounding prong is 0.184 inches.

FIG. 3 is an illustration of a cross-sectional perspective view of one embodiment of a prior art grounding prong socket 28 with a tubular grounding prong 30 placed inside. The socket has a cross-section similar to the cross-section of the U-shaped prong, but is made for the dimensions of the tubular prong. A seam 26 is placed at the top of the socket. FIG. 4 is an illustration of the cross-sectional perspective view of the prior art embodiment 28 shown in FIG. 3 with a U-shaped prong 36 inside the prior art socket 28. Seam 34 creates a much wider gap, indicating that the prior art socket 28 is stretched to accommodate the U-shaped prong with larger dimensions than the tubular prong. Because the prior art socket 28 is stretched, when the U-shaped prong is removed and the tubular prong is inserted, the stretched socket no longer firmly fits the tubular prong, causing improper grounding, which could cause an electrical shock.

In the prior art there are other embodiments of grounding sockets. These sockets stretch or bend for the larger U-shaped prong, causing improper contact between the stretched socket and the smaller tubular prong. Other examples of prior grounding prong sockets are disclosed in U.S. Pat. Nos. 3,467,939, 3,891,289, and 4,018,492 which are herein incorporated by reference.

SUMMARY OF THE INVENTION

It is an of the invention to provide a grounding socket a firm fit for both a U-shaped grounding prong and a tubular prong.

It is object of the invention to provide a grounding socket that is not stretched by a U-shaped grounding prong, would cause improper grounding for a tubular grounding prong.

It is another object of the invention to provide an inexpensive socket which can accommodate repeated insertions of U-shaped grounding prongs and a tubular grounding prongs.

It is another object of the invention to provide a receptacle for a three prong electrical plug with a tubular or U-shaped grounding prong, wherein the receptacle provides good electrical contact with both plugs with tubular grounding prongs and U-shaped grounding prongs.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention provides a socket for grounding prongs with a cross-section of dimensions to accommodate a U-shaped prong, and with a raised point near the center of the bottom of the socket to allow a firm fit of a tubular prong in the socket to allow proper grounding. Since the raised point is near the center of the bottom of the socket, it will be unaffected by the larger dimensions of the U-shaped grounding prong.

The invention also provides a 5-15 receptacle which utilizes the inventive socket.

DESCRIPTIONS OF THE PREFERRED EMBODIMENTS

Figure 1:
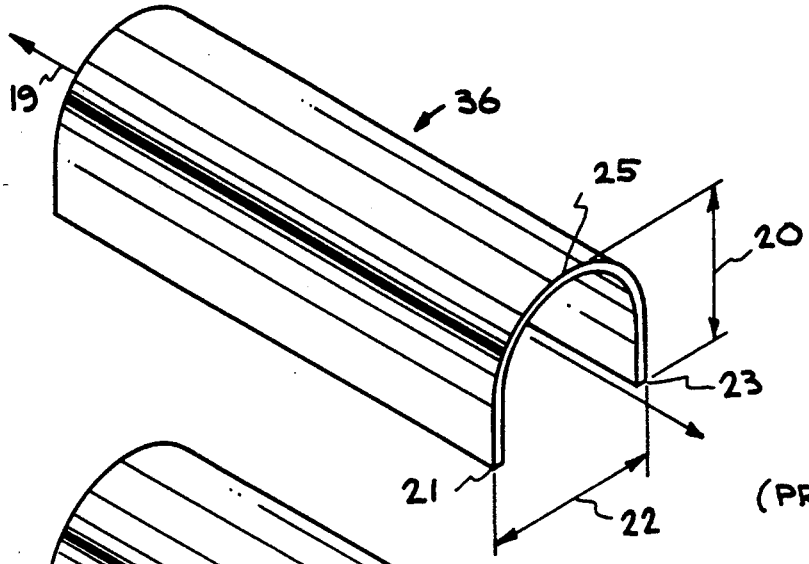
FIG. 1 (PRIOR ART)
FIG. 1 is an illustration of a cross-sectional perspective view of a prior art U-shaped grounding prong.
Figure 2:
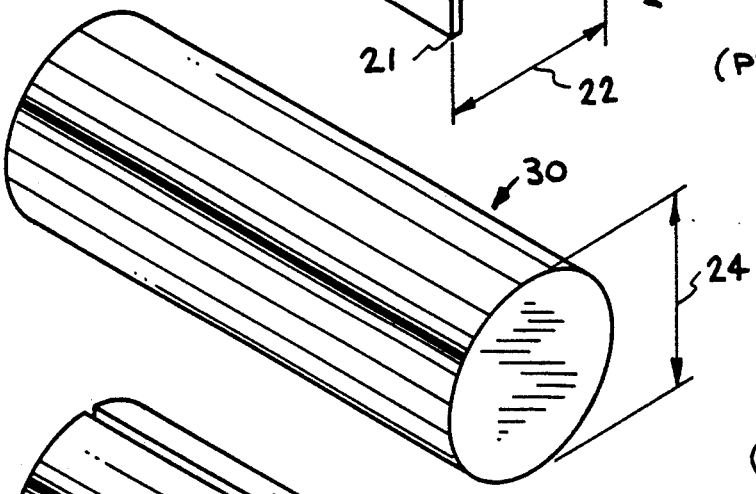
FIG. 2 (PRIOR ART)
FIG. 2 is an illustration of a cross-sectional perspective view of a prior art tubular grounding prong.
Figure 3:
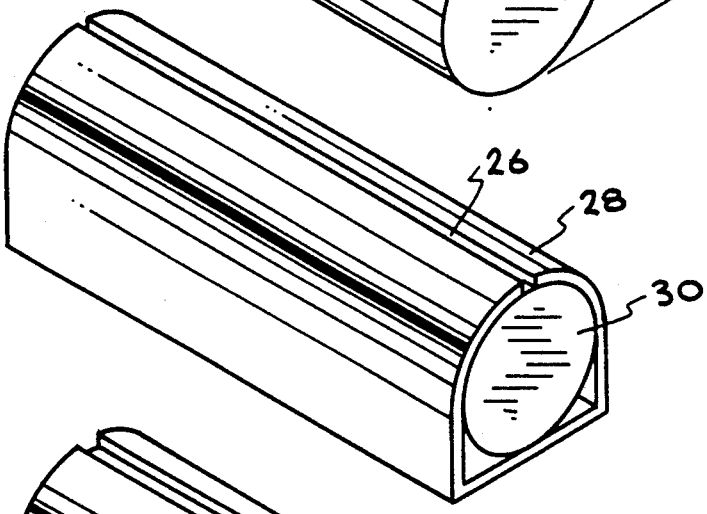
FIG. 3 (PRIOR ART)
FIG. 3 is an illustration of a cross-sectional perspective view of a prior art grounding prong socket with a tubular grounding prong inside.
Figure 4:
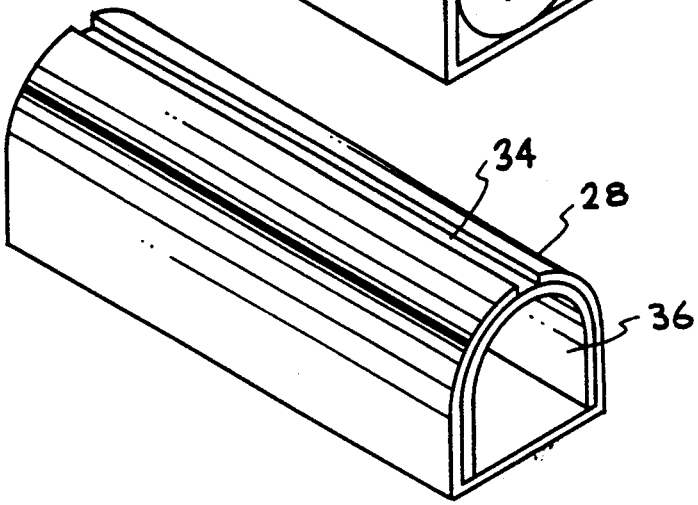
FIG. 4 (PRIOR ART)
FIG. 4 is an illustration of a cross-sectional perspective view of a prior art grounding prong socket with a U-shaped grounding prong inside.
Figure 5:
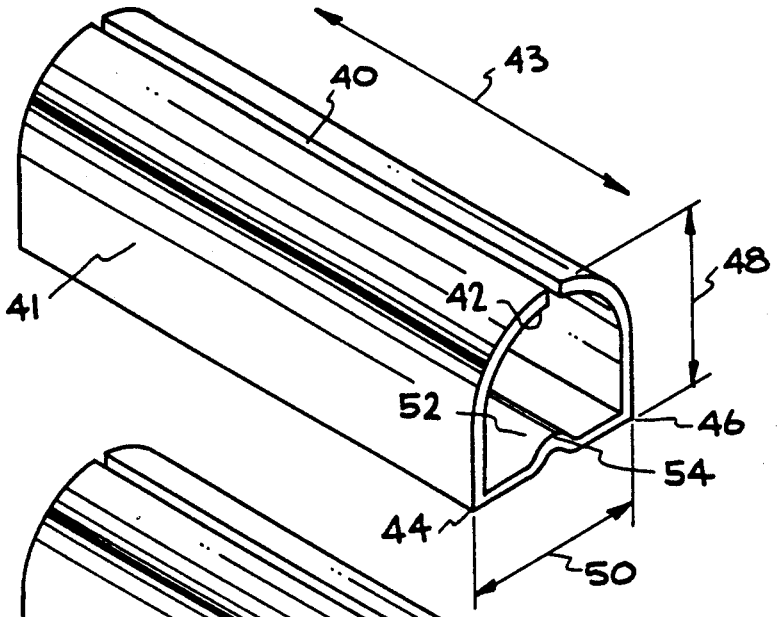
FIG. 5 is an illustration of a cross-sectional perspective view of a preferred embodiment of the inventive grounding prong socket.
Figure 7:
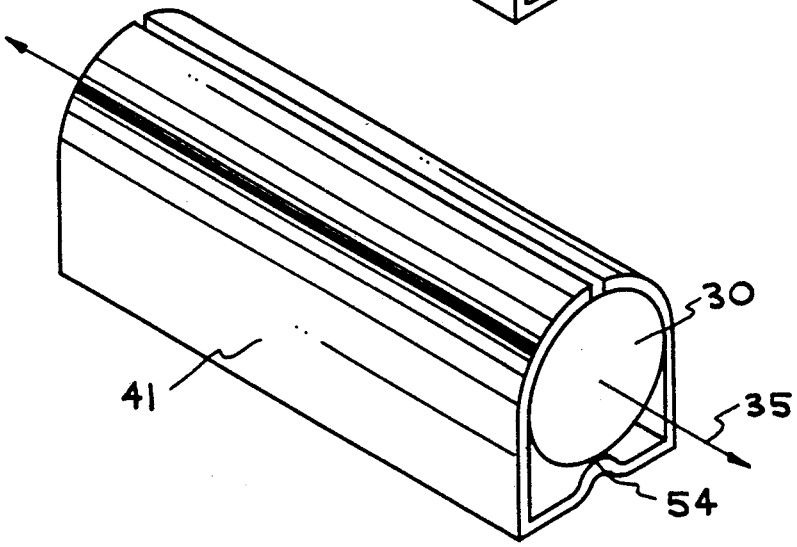
FIG. 7 is an illustration of a cross-sectional perspective view of the embodiment in FIG. 5 with a tubular prong inserted.

As in the art, a preferred embodiment of the inventive socket uses a plate of conducting material rolled into a tubular shape, wherein a cross-sectional perspective view of the tubular shape is shown in FIG. 5. The tubular shape forms which forms an inventive socket 41 shown in FIG. 5 has a seam 40 at the top of the socket. A line 43 is a line which is parallel to the central axis of the tubular shape socket 41. FIG. 7 shows the central axis 35 of the tubular socket 41. The inside top 42 of the socket is a part of the socket 41 which would be near the top of a U-shaped prong when the U-shaped prong is inserted in the socket 41. As described earlier, the horizontal distance is defined as the distance perpendicular to the central axis 35 and parallel to a line which goes from the first foot point 44, which is the area where the bottom of the first foot of the U-shaped prong would rest when the U-shaped prong is inserted in the inventive socket 41 to the second foot point 46, which is the area where the bottom of the second foot of the U-shaped prong would rest when the U-shaped prong was inserted in the inventive socket 41. The vertical distance is the distance along a line perpendicular to the horizontal and perpendicular to the central axis 35. The height for accommodating a U-shaped prong is the vertical distance between the inside top 42 of the socket and the first foot point 44. The height 48 of the inventive socket is between 0.186 and 0.200 inches. The width 50 of the socket is defined as the horizontal distance between the first and second foot points 44 and 46, and is between 0.186 and 0.200 inches. The first foot point 44 and the second foot point 46 are approximately equal distances from the top 42 of the socket, with the first foot point 44 being on a first side of the top of the socket and the second foot point being on a second side of the top of the socket as shown in FIG. 5. The inventive aspect of the invention is a ridge 52, which provides ridge top 54, which is the part of the ridge 52 which would be in contact with a tubular prong when a tubular prong is inserted in the inventive socket 41. The vertical distance between the ridge top 54 and the top 42 of the socket is between 0.180 and 0.184 inches. The vertical distance between the ridge top 54 and the first foot point is between 0.002 and 0.020 inches.

Figure 6:
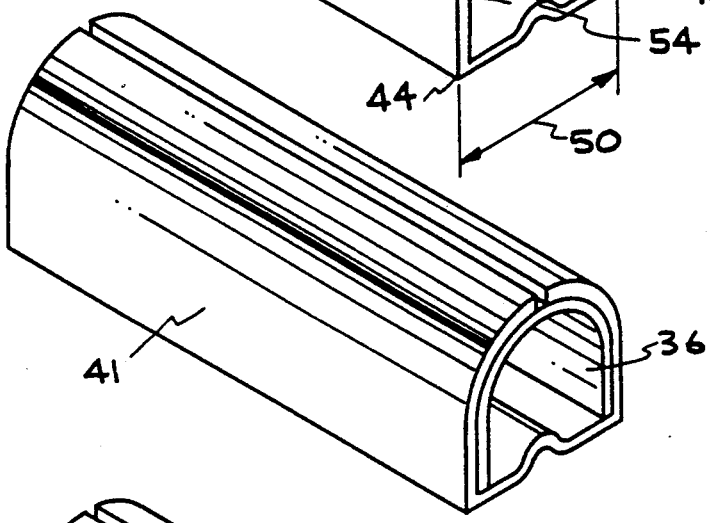
FIG. 6 is an illustration of a cross-sectional perspective view of the embodiment in FIG. 5 with a U-shaped prong inserted.

FIG. 6 is an illustration of the cross-sectional perspective view of the preferred embodiment of the inventive socket 41 shown in FIG. 5 with a U-shaped prong 36 inside. Since the inventive grounding socket is made for the dimensions of the U-shaped prong, minimal bending occurs when the U-shaped prong is inserted. FIG. 7 is an illustration of the cross-sectional perspective view of the preferred embodiment of the inventive socket 41 shown in FIG. 5 with a tubular prong 30 inside. Although the socket 41 is made with the dimensions of the U-shaped grounding prong, the ridge top 54 creates a tight fit for the smaller tubular grounding prong, thus allowing a proper grounding, even if the inventive grounding socket is stretched to the size of the U-shaped grounding prong.

Figure 8:
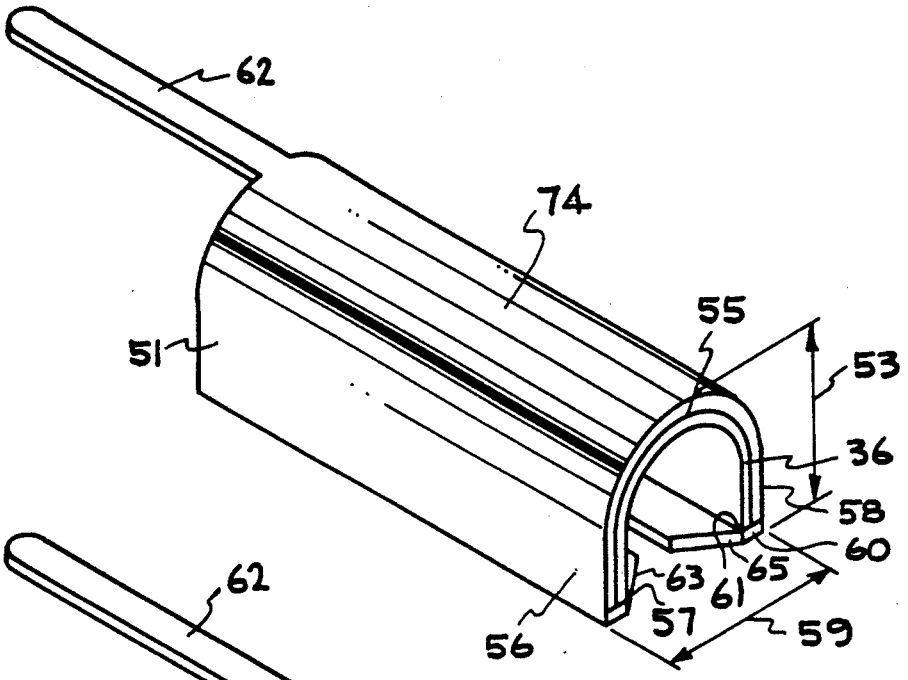
FIG. 8 is an illustration of a cross-sectional perspective view of another embodiment of the inventive grounding prong with a U-shaped prong inserted.
Figure 9:
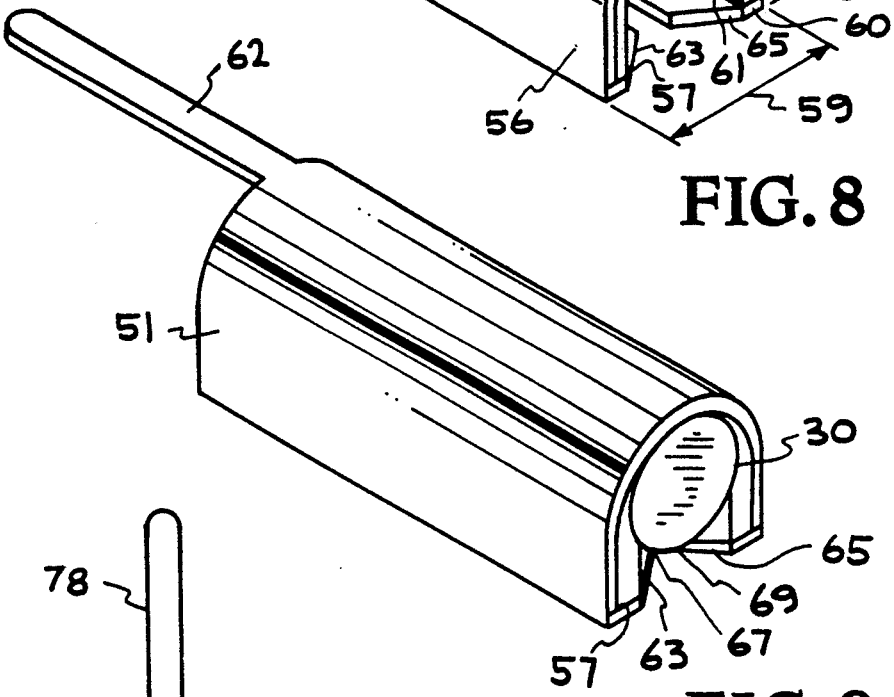
FIG. 9 is an illustration of a cross-sectional perspective view of the embodiment in FIG. 8 with a tubular prong inserted.

FIG. 8 is an illustration of the cross-sectional perspective view of another embodiment of the inventive socket 51 with a U-shaped grounding prong 36 inside. Again the socket is designed around the dimensions of the U-shaped grounding prong. As in the previous embodiment, the height 53 of the socket, which is the vertical distance between the inside top 55 of the socket and the first foot point 57 is between 0.186 and 0.200 inches. The width 59 of the socket which is the horizontal from the first foot point 57 to the second foot point is between 0.186 and 0.200 inches. FIG. 9 is an illustration of a cross-sectional perspective view of the embodiment of the inventive socket 51, illustrated in FIG. 8, with a tubular grounding prong 30 inside. Although the inventive socket in this embodiment is large enough to accommodate the U-shaped prong, the socket has two ridges 63 and 65 with two ridge tops 67 and 69. The ridge tops 67 and 69 are the parts of the ridges that contact a tubular prong, when a tubular prong 30 is inserted in the inventive socket 51 and causes the tubular plug to fit snugly, establishing a proper ground. The ridges are located to minimize stretching when the U-shaped prong is inserted in the socket. The vertical distance between the first foot point 57 and the first ridge top 67 is between 0.002 and 0.080 inches.

A flange 62 is placed at the end of the socket to make it easier to connect a grounding wire to the socket. The flange 62 is a simple flange, which is shown as a possible termination. Other flanges or configurations could be attached to or performed with the socket to accommodate various devices such as wall outlets, chassis, and cable receptacles.

In the present embodiment, ridges 63 and 65 also perform the function of preventing a U-shaped prong from spreading the socket beyond a desired width. This is accomplished by having ridges 63 and 65 wrap around the legs of the U-shaped prong, thus preventing the socket from spreading. Other embodiments may also prevent further spreading by using a more elastic metal or by other means.

The inside top 55 of the socket is at the center of a top wall 74 of the socket. A first side wall 56 and a second side wall 58 are attached to the sides of the top wall 74. The foot points and the ridges form a bottom wall 60 of the socket.

Figure 10:
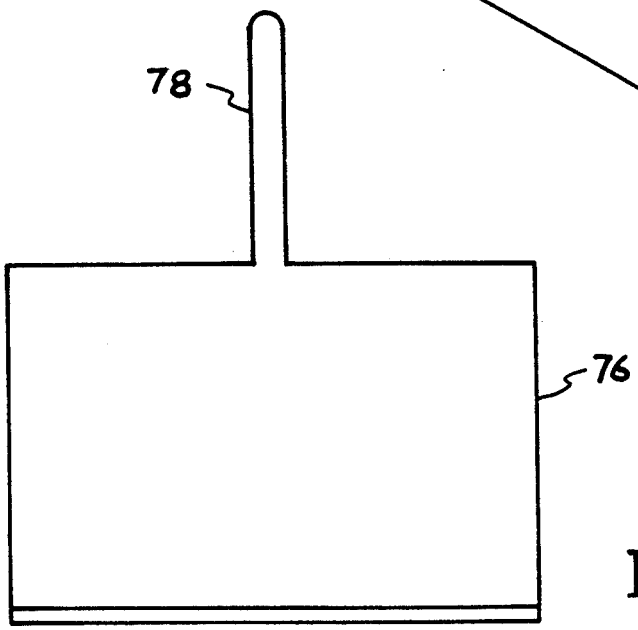
FIG. 10 is an illustration of a cross-sectional perspective view of a plate which may be used to manufacture the embodiment shown in FIG. 8.

One method of manufacturing the inventive embodiments is by using a thin rectangular plate of copper or other conducting material and bending it into a tubular shape to produce the inventive embodiments. FIG. 10 is a cross-sectional perspective view of a thin rectangular plate 76 with a flange 78 attached to it. The thin rectangular plate can be bent into a tubular shape to form the embodiment shown in FIGS. 8 and 9.

Figure 11:
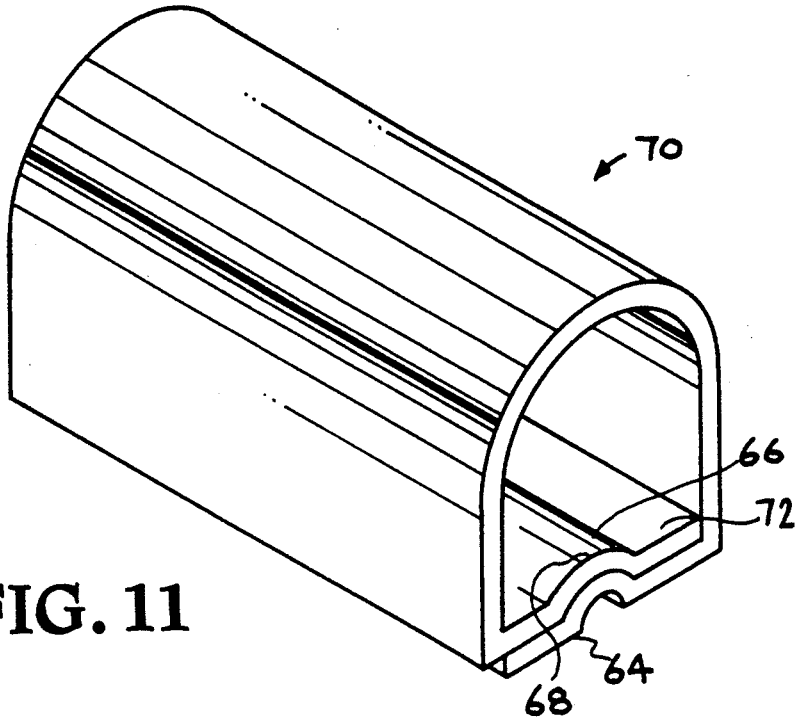
FIG. 11 is an illustration of a cross-sectional perspective view of another embodiment of the inventive socket.

FIG. 11 is a cross sectional perspective view of another embodiment of the inventive socket 70. The socket is made from a rectangular metal sheet, which is rolled into a tubular shape as shown in FIG. 11. Two ends 72 and 64 of the sheet overlap at the bottom of the socket 70. A ridge 66 with a ridge top 68 is formed in the overlapping edges. Since the ridge 66 is formed in both of the ends 72 and 64, if a grounding prong causes any spreading, the ridge causes the socket to return to its original shape when the grounding prong is removed. This embodiment of the inventive socket 70 works in the same manner as the other embodiments of the inventive socket to provide proper grounding for U-shaped prongs and tubular prongs used interchangably.

The inventive socket is not limited to a hemicylindrically shaped cross-section, but may also have a square, rectangular, or triangular cross-section or may have other forms as within the scope of the claims.

Figure 12:
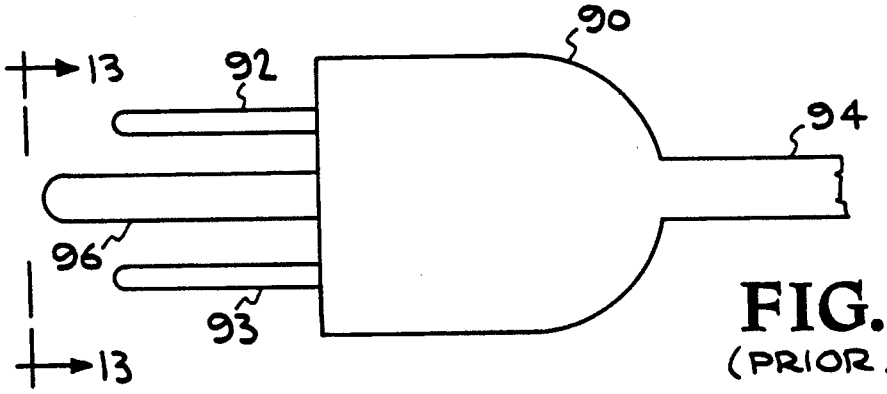
FIG. 12 (PRIOR ART)
FIG. 12 is an illustration of a side view of a three prong electrical plug used in the prior art.
Figure 13:
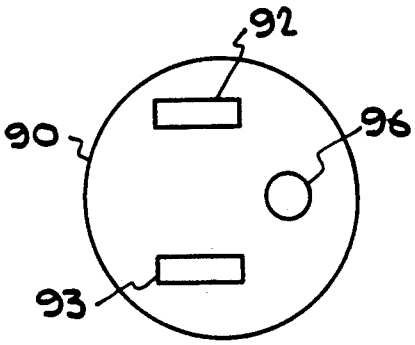
FIG. 13 (PRIOR ART)
FIG. 13 is an illustration of a front view of a three prong electrical plug illustrated in FIG. 12, with a tubular grounding prong.
Figure 14:
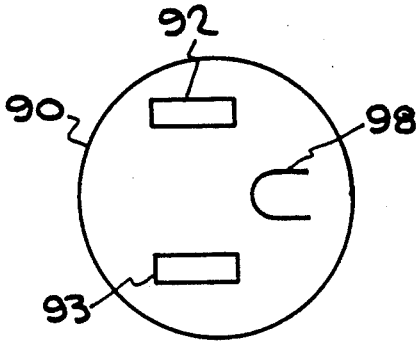
FIG. 14 (PRIOR ART)
FIG. 14 is an illustration of a front view of a three prong electrical plug with a U-shaped grounding prong used in the prior art.

FIG. 12 illustrates a side view of a three prong electrical plug 90, used in the prior art, attached to an electrical cord 94. This type of electrical plug is designated as Configuration 5-15P by the American National Standard Institute and the National Electrical Manufacturing Association. The plug comprises a first current carrying blade 92 and a second current carrying blade 93 parallel to the first current carrying blade as shown and a grounding prong 96. FIG. 13 illustrates a front view of FIG. 12 along view lines 13. The 5-15P configuration is an electrical plug designed for 120 volt alternating current (AC). The 5-15P (or 5-15 plug) configuration allows for a grounding prong with a round cross-section 96 or as shown in FIG. 14 a grounding prong with a U-shaped cross-section 98. The dimensions of these grounding prongs are specified earlier in the specification. The first current carrying blade 92 is electrically attached to a first wire for carrying current, not shown. The second current carrying blade 93 is electrically attached to a second wire for carrying current. The grounding prong 96 or 98 is electrically attached to a grounding wire, which is usually electrically attached to the body of the device for which the 5-15 plug is used. The wires run through the electrical cord 94.

Figure 15:
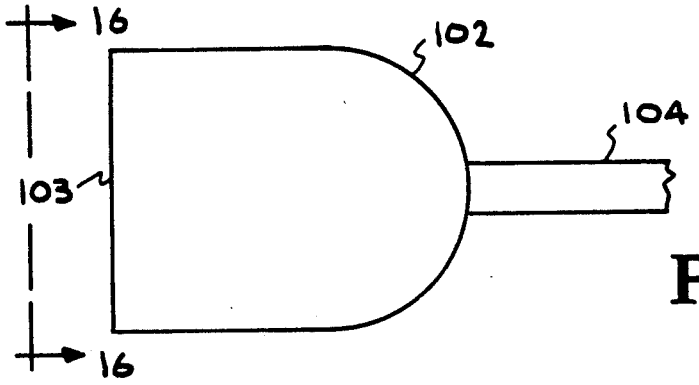
FIG. 15 is an illustration of a side view of an embodiment of the inventive receptacle.
Figure 16:
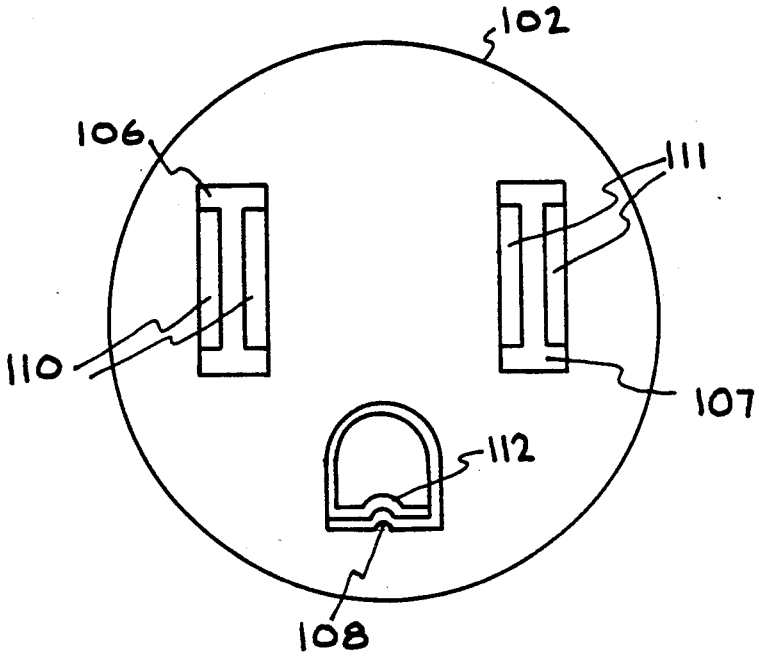
FIG. 16 is an illustration of a front view of the embodiment of the inventive receptacle illustrated in FIG. 15.

FIG. 15 illustrates a side view of a receptacle 102 attached to an electrical cord 104. FIG. 16 illustrates a front view of FIG. 15 along view lines 16, which shows a first surface 103 of the receptacle. The first surface 103 the receptacle 102 has a first slot for the first current carrying blade 92 of the plug 90. The first surface 103 also has a second slot 107 for the second current blade 93 of the plug 90. In addition, the first surface 103 has an opening 108 for a tubular grounding prong 96 or U-shaped grounding prong 98. This type of configuration is designated as 5-15R by the American National Standard Institute. The "R" in 5-15R stands for , while the "P" in 5-15P stands for plug. Further descriptions of 5-15 plugs and receptacles are in the "American National Standard on dimensions of plugs and receptacles," 1973, page 10, published by the American National Standards Institute Inc, NY, incorporated by reference. A first set of conducting contacts 110 is positioned in the receptacle 102 next to the first slot 106, so that when the plug 90 is inserted into the receptacle, the first set of conducting contacts 110 establishes electrical contact with the first current carrying blade 92. A second set of conducting contacts 111 is positioned in the receptacle 102 next to the second slot 106, so that when the plug 90 is inserted into the receptacle, the second set of conducting contacts 111 establishes electrical contact with the second current carrying blade 93. A grounding prong socket 112 is placed in the receptacle 102 and adjacent to the opening 108 so that when a tubular 96 or U-shaped 98 grounding prong is inserted into the opening 108, the socket 112 establishes electrical contact with the tubular 96 or U-shaped 98 grounding prong. The grounding prong socket 112 used in this embodiment is the socket 70 illustrated in FIG. 11. The grounding prong sockets described in other embodiments of the invention can also be used in this inventive receptacle. The first set of electrical contacts 110 is electrically connected to a first current carrying wire, which is not shown. The second set of electrical contacts 111 is electrically connected to a second current carrying wire. The socket 112 is electrically connected to a grounding wire. All three wires r the electric cord 104. Such types of electrical receptacles are on extension cords.

Figure 17:
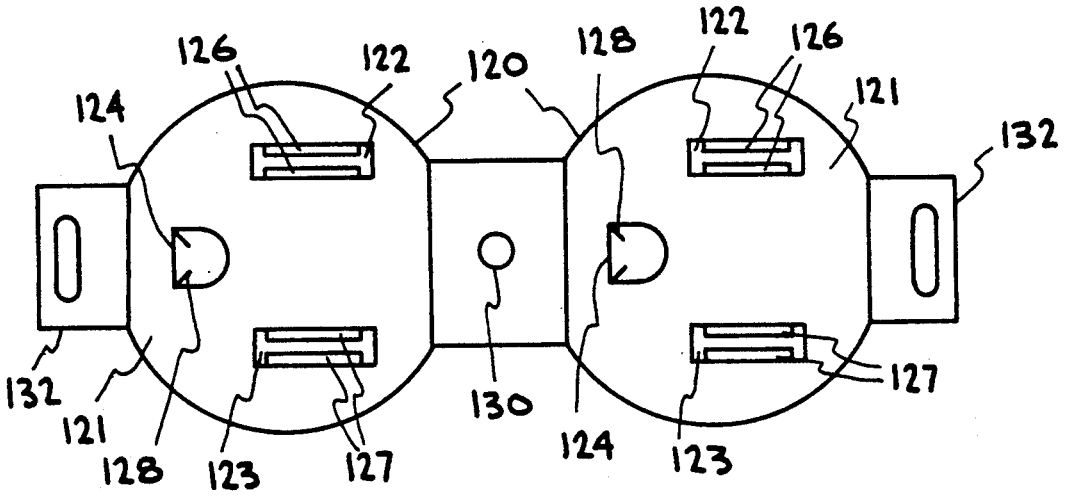
FIG. 17 is an illustration of a wall outlet that uses a pair of receptacles which are an embodiment of the invention.

FIG. 17 illustrates a pair of receptacles 120 used in a wall outlet. Each receptacle 120 has a first surface 121. Each first surface 121 has a first slot 122 for receiving the first current carrying blade 92 of the plug 90. Each first surface 121 of a receptacle 120 also has a second slot 123 for receiving the second current carrying blade 92 of the plug. In addition, each first surface 121 has an opening 124 for a tubular 96 or a U-shaped 126 grounding prong. A first set of conducting contacts 98 is positioned in a receptacle 120 adjacent to the first slot 122, so that when the plug 90 is inserted into the receptacle, the first set of conducting contacts 122 establishes electrical contact with the first current carrying blade 92. A second set of conducting contacts 127 is positioned in a receptacle 120 adjacent to the second slot 123, so that when the plug 90 is inserted into the receptacle, the second set of conducting contacts 123 establishes electrical contact with the second current carrying blade 93. A grounding prong socket 128 is placed in the receptacle and adjacent to an opening 124, so that when a tubular 96 or U-shaped 98 grounding prong is inserted into the opening 124, the grounding prong socket 128 establishes electrical contact with the tubular 96 or U-shaped 98 grounding prong. A screw hole 130 is provided to allow a face plate to be attached to the receptacles 120. Tabs 132 provide a means of attaching the receptacles 120 to an electrical box in a wall. The first set of electrical contacts 126 is electrically connected to a first current carrying wire, which is not shown. The second set of electrical contacts 127 is electrically connected to a first carrying wire. The socket 128 is electrically connected to a grounding wire. The grounding prong socket 128 used in this embodiment is the socket 51 illustrated in FIG. 9. Other inventive grounding prong sockets can also be used in this receptacle.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A tubular socket for holding tubular and U-shaped grounding prongs, comprising:

a top wall of the tubular socket made of a conducting material;

a first side wall of the tubular socket made of a conducting material and joined to the top wall;

a second side wall of the tubular socket made of a conducting material and joined to the top wall;

a bottom wall of the tubular socket wherein a first side of the bottom wall is electrically connected to the first side wall and a second side of the bottom wall is electrically connected to the second side wall, said bottom wall further comprising a first foot point, wherein the first foot point is located a first vertical distance below the top wall and a first horizontal distance from the center of the top wall on a first side of the center of the top wall, a second foot point, wherein the second foot point is located a second vertical distance below the center of the top wall and a second horizontal distance from the center of the top wall on a second side of the center of the top wall, wherein the first vertical distance is substantially equal to the second vertical distance and the first horizontal distance is substantially equal to the second horizontal distance, and a first ridge with a first ridge top, wherein part of the ridge is horizontally located between the first and second foot points and the first ridge top is vertically located between the first foot point and the top wall, so that the vertical distance between the first ridge top and the top wall is less than the first vertical distance, and wherein the first side of the bottom wall overlaps with the second side of the bottom wall, wherein the ridge is formed where the first side of the bottom half overlaps with the second side of the bottom half so that the ridge is formed in both the first side of the bottom half and the second side of the bottom half.

2. A tubular socket as claimed in claim 1, wherein the first and second vertical distances are between 0.186 and 0.200 inches, and wherein the first and second horizontal distances are between 0.093 and 0.100 inches.

3. A tubular socket as claimed in claim 2, wherein the ridge top is vertically displaced between 0.002 and 0.080 inches above the first foot point.

4. A tubular socket as claimed in claim 3, further comprising an electrical connection means for providing an electrical connection between the top wall and a grounding wire for an 5-15 receptacle.

* * * * *